US006896742B2

(12) United States Patent
Geyer et al.

(10) Patent No.: US 6,896,742 B2
(45) Date of Patent: May 24, 2005

(54) BRUSHLESS SCRUB HEAD FOR SURFACE MAINTENANCE

(75) Inventors: Robert A. Geyer, Minnetonka, MN (US); Anthony John Hamline, St. Paul, MN (US); Ian Taylor, Eagan, MN (US); Christopher K. Pearce, Windom, MN (US)

(73) Assignee: Tennant Company, Minneapolis, MN (US)

( * ) Notice: Subject to any disclaimer, the term of this patent is extended or adjusted under 35 U.S.C. 154(b) by 305 days.

(21) Appl. No.: 10/160,339

(22) Filed: May 31, 2002

(65) Prior Publication Data

US 2002/0178529 A1 Dec. 5, 2002

Related U.S. Application Data

(60) Provisional application No. 60/295,106, filed on May 31, 2001.

(51) Int. Cl.[7] ..... A47L 11/30; B08B 3/02; B08B 3/04; E01H 1/10

(52) U.S. Cl. ..... 134/21; 15/320; 15/340.1

(58) Field of Search ..... 15/320, 340.1–340, 15/385; 134/21

(56) References Cited

U.S. PATENT DOCUMENTS

| | | | | |
|---|---|---|---|---|
| 3,709,436 A | | 1/1973 | Foster | 239/287 |
| 3,726,481 A | | 4/1973 | Foster et al. | 239/287 |
| 3,799,443 A | | 3/1974 | Foster et al. | 239/163 |
| 3,848,804 A | | 11/1974 | Prestwich | 239/160 |
| 3,877,643 A | | 4/1975 | Smith et al. | 239/102 |
| 3,942,214 A | | 3/1976 | Maasberg | 15/320 |
| 3,959,010 A | | 5/1976 | Thompson et al. | 134/21 |
| 3,987,964 A | | 10/1976 | Pittman et al. | 239/169 |
| 3,998,387 A | | 12/1976 | Maasberg | 239/102 |
| 4,096,601 A | * | 6/1978 | Knestele | 15/320 |
| 4,158,901 A | | 6/1979 | Wulff et al. | 15/401 |
| 4,168,562 A | | 9/1979 | Maasberg | 15/320 |
| 4,191,589 A | | 3/1980 | Halls et al. | 134/21 |
| 4,191,590 A | | 3/1980 | Sundheim | 134/21 |
| 4,219,155 A | | 8/1980 | Goerss | 239/124 |
| 4,377,018 A | | 3/1983 | Cain | 15/322 |
| 4,527,739 A | | 7/1985 | Parma et al. | 239/186 |
| 4,756,048 A | * | 7/1988 | Kauffeldt et al. | 15/320 |
| 4,822,431 A | | 4/1989 | Bricher et al. | 134/18 |
| 4,845,801 A | | 7/1989 | Milly et al. | 15/321 |
| 5,078,161 A | | 1/1992 | Raghavan et al. | 134/16 |
| 5,199,128 A | | 4/1993 | Stubbs | 15/52 |
| 5,224,236 A | | 7/1993 | Sallquist | 15/321 |

(Continued)

FOREIGN PATENT DOCUMENTS

| | | | |
|---|---|---|---|
| DE | 2332740 | 1/1974 | E01H/1/00 |
| DE | 2457708 | 6/1976 | |

(Continued)

*Primary Examiner*—Terrence R. Till
(74) *Attorney, Agent, or Firm*—Fulbright & Jaworski LLP

(57) ABSTRACT

A device and method of use for cleaning a ground surface with pressurized cleaning solution is disclosed. The device includes a transportable deck having at least a first chamber and a second chamber, each first and second chamber being in open communication with the surface, said first chamber having a nozzle for directing a pressurized cleaning solution toward the ground surface, and said second chamber having a vacuum outlet for removing cleaning solution and debris from the surface. Additional embodiments of the present invention may include a solution recycling system for reusing recovered solution.

41 Claims, 7 Drawing Sheets

U.S. PATENT DOCUMENTS

| | | | | |
|---|---|---|---|---|
| 5,265,805 | A | 11/1993 | Artenian | 239/135 |
| 5,460,657 | A | 10/1995 | Ally | 134/20 |
| 5,469,597 | A | 11/1995 | Page | 15/321 |
| 5,500,976 | A | 3/1996 | Rohrbacher et al. | 15/320 |
| 5,501,396 | A | 3/1996 | Rohrbacher et al. | 239/7 |
| 5,601,659 | A | 2/1997 | Rohrbacher et al. | 134/10 |
| 5,704,989 | A | 1/1998 | Page | 134/10 |
| 5,711,051 | A | 1/1998 | Roden | 15/321 |
| 5,826,298 | A | 10/1998 | Rohrbacher et al. | 15/321 |
| 5,970,574 | A | 10/1999 | Thrash, Jr. | 15/321 |
| 5,991,968 | A | 11/1999 | Moll et al. | 15/322 |
| 6,105,204 | A | 8/2000 | Scharwat | 15/322 |
| RE37,162 | E | 5/2001 | Roden | 15/321 |
| 6,302,967 | B1 | 10/2001 | Rohrbacher et al. | 134/10 |
| 6,378,163 | B1 | 4/2002 | Moll et al. | 15/322 |

FOREIGN PATENT DOCUMENTS

| | | | | |
|---|---|---|---|---|
| DE | 2727291 | | 12/1978 | B08B/3/02 |
| DE | 3133789 | | 7/1983 | E01H/1/10 |
| DE | 20118674 | * | 2/2002 | |
| EP | 0 104 345 | * | 4/1984 | |
| EP | 0 773 327 | * | 11/1996 | |
| EP | 1020566 | | 7/2000 | |
| FR | 2590290 | | 5/1985 | E01H/1/08 |
| FR | 2 655 072 | * | 5/1991 | |
| JP | 11-99111 | * | 4/1999 | |
| WO | WO 95/24530 | * | 9/1995 | |
| WO | WO 98/27856 | * | 7/1998 | |

* cited by examiner

BRUSHLESS SCRUB HEAD FOR SURFACE MAINTENANCE

CROSS REFERENCE TO RELATED APPLICATION

This application claims the benefit of priority of U.S. Ser. No. 60/295,106, filed May 31, 2001, pursuant to 35 U.S.C. §119, and the entire disclosure of which is incorporated in its entirety by reference herein.

FIELD OF THE INVENTION

The present invention relates generally to surface maintenance or conditioning machines, and particularly those machines employing one or more surface maintenance or conditioning appliances or tools that perform one or more tasks including, among others, scrubbing, sweeping, and vacuuming. More specifically, the present invention is particularly directed to a combination high-pressure spray cleaning system and a spent-solution recovery system.

BACKGROUND OF THE INVENTION

Brush-type scrubbing systems and appliances are of course well known for surface maintenance, particularly floor surfaces. However, in some high demand or difficult surface maintenance applications and environments, brush-type-scrubbing systems may be inadequate. Examples of high demand or difficult cleaning applications include, among others, parking lots, airport runways, gas stations, and the like.

Pressure washers or water blasting or jetting systems are of course well known and commercially available. Manufacturers of such water blasting systems and pressure washers include, among others, Vactor, Jetstream, Gardener Denver Water Jetting, Aqua-Dyne, Hammelmann, and Imperial Industries.

SUMMARY OF THE INVENTION

An object of the present invention is to provide a high-pressure spray cleaning system.

Another object of the invention is to provide a combination high-pressure spray cleaning system and solution recovery system.

Another object of the invention is to provide a combination high-pressure spray cleaning system and solution recovery system intended to be coupled to a transport vehicle.

Yet, another object of the invention is to provide a combination high-pressure spray cleaning system and solution recovery system intended to be coupled to a transport vehicle with a solution recycling system for solution reuse.

In accordance with the present invention, a brushless scrub head for cleaning a surface comprises a spraying head system having one or more spraying nozzles from which a high-pressure solution exits therefrom and a solution recovery chamber for removing solution and debris from a surface. In an exemplary embodiment, a hydraulic motor is employed for driving the a rotary spraying head system and controlling the speed of rotation thereof, independent of the pressure of the solution exiting the nozzles. A high-pressure fluid solution pump may be provided for independently controlling the solution spray pressure exiting the nozzles.

Further, in accordance with the present invention, the brushless scrub head is constructed to include a highly efficient solution recovery system.

Further, in accordance with an exemplary embodiment of the present invention, the combination brushless scrub head and recovery system is coupled to a transport vehicle including a self contained, solution tank system, solution recovery tank system and/or solution recycling system.

DETAILED DESCRIPTION OF THE INVENTION

Figure 1:
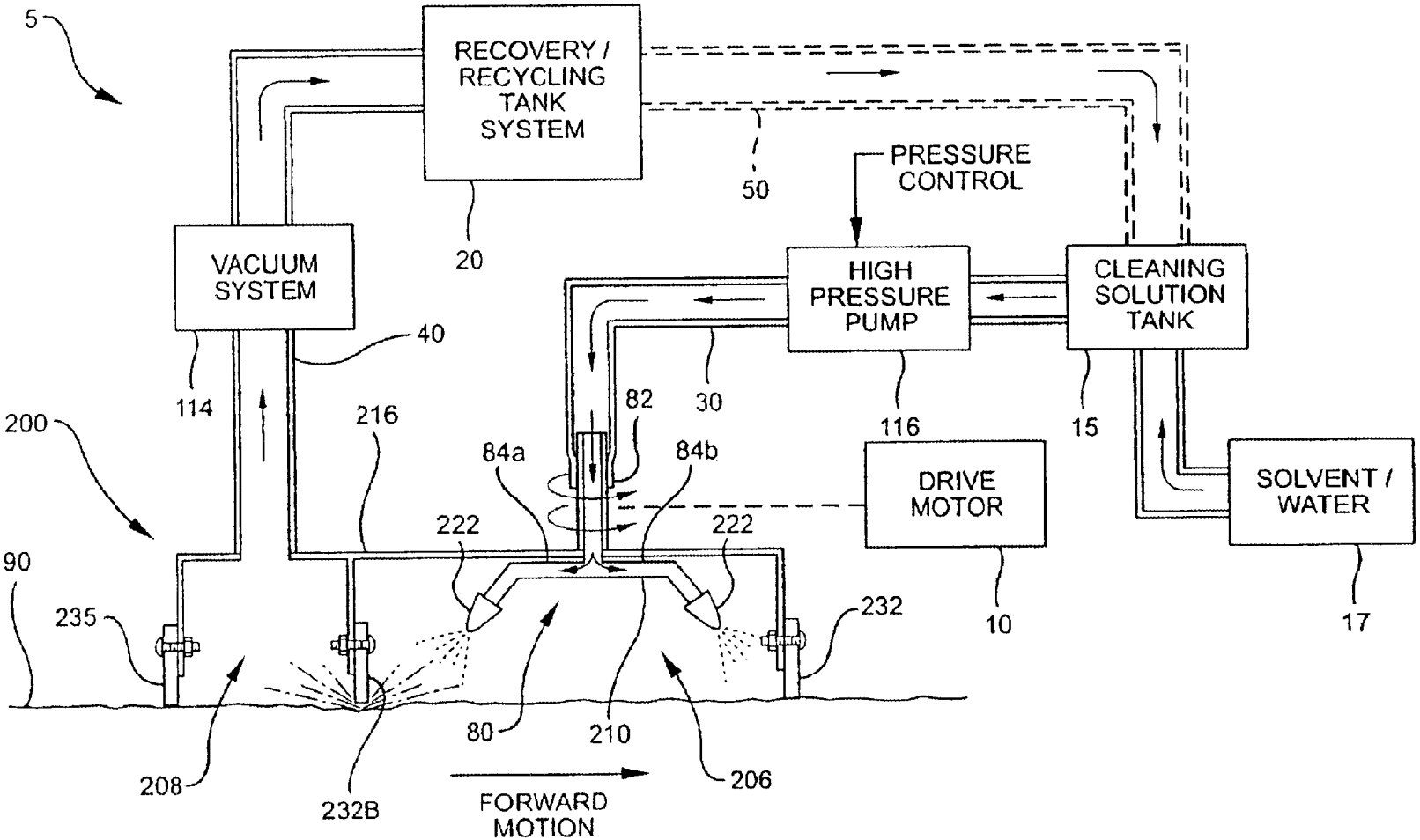
FIG. 1 a block diagram of the brushless scrub head system in accordance with present invention.

Illustrated in FIG. 1 is a block diagram of a scrubless head cleaning system 5 in accordance with the present invention and further employing a scrubless cleaning head 200 embodying further several aspects of the present invention. More specifically, a rotatable solution spraying wand system 80 includes a fluid carrying shaft 82 coupled to fluid carrying wands 84*a* and 84*b*, each terminating with a nozzle 222. Nozzle 222 and wands 84*a* and 84*b* are configured to have a selected spraying pattern for directing a solution at a selected angle relative to a horizontal surface 90. Shaft 82 is coupled to drive motor 10 for causing shaft 82 to spin at a selected spin rate. Drive motor 10 may be a hydraulic motor, an electric motor, an air motor or combinations thereof.

In one embodiment of the invention, scrubless cleaning head 200 is constructed to form an open ended spraying chamber 206 and an open ended vacuum chamber 208, each chamber 206, 208 being open to the surface to be cleaned. It is intended that spinning wands 84*a*, 84*b* spin and solution spray exits nozzles 222 within spraying chamber 206. Vacuum chamber 208 is intended to be coupled to spraying chamber 206 so as to follow chamber 208 when the scrubless cleaning head 200 is moving in the forward direction as illustrated in the drawings.

A vacuum system 114 is coupled to vacuum chamber 208 through a conduit 40 for collecting spent solution exiting from nozzles 222 after being directed toward surface 90. In turn the collected solution may be transferred to a recovery/recycling tank system 20. For a recycling tank system, collected solution may be recycled and used as the cleaning solution as depicted by the dotted line conduit 50 coupled to the cleaning solution tank 15. A variety of known recycling technologies may be utilized to recycle the collected solution, including but not limited to mesh media filters, porous filters, hydrocyclones, or combinations thereof. Alternatively, as illustrate in the drawing, cleaning solution tank 15 may be coupled to a source 17 of solution, e.g., water, or alternatively to a solvent or detergent that may be added to an aqueous solution as is well known in the art.

Figure 2:
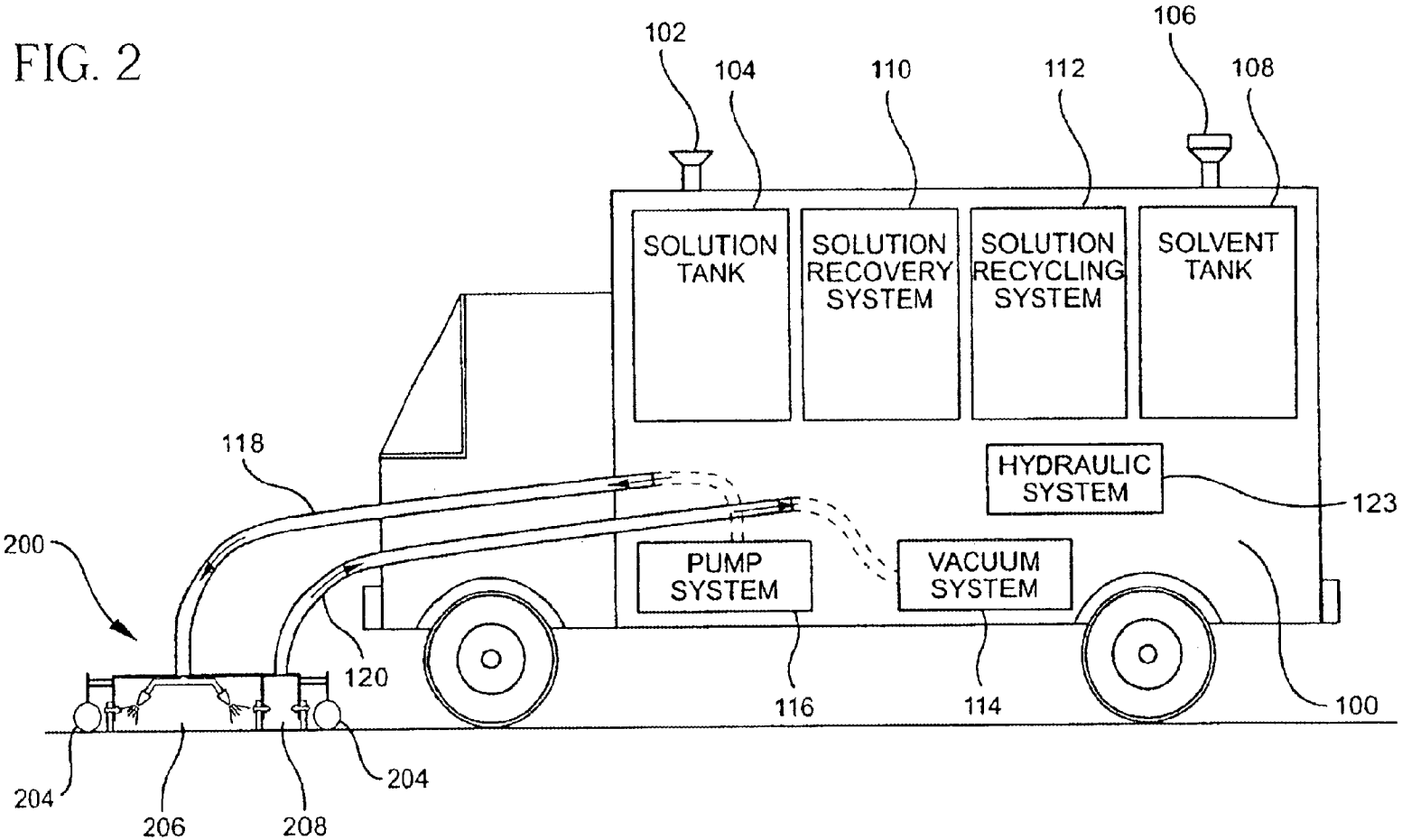
FIG. 2 is a side view of a surface maintenance vehicle employing a brushless cleaning head system in accordance with the present invention.

Illustrated in FIG. 2 is a surface maintenance vehicle, generally indicated by numeral 100. Surface maintenance vehicle 100 may include, among other components and systems, a solution inlet 102, a solvent inlet 106, a solution tank 104, a solvent tank 108, a recovery tank 110, a solution recycling system 112. Further, surface maintenance vehicle 100 may also include: a vacuum system 114, a pumping system 116 for a pressurized spray cleaning system, a solution deliver system 118, a recovered solution transport system 120, brushless scrub head 200, a hydraulic system 123, and requisite piping and valves, well known in the art and not shown, to enable a variety of system configurations. Alternative embodiments of surface maintenance vehicles may also be used to practice aspects of the present invention.

Figure 3:
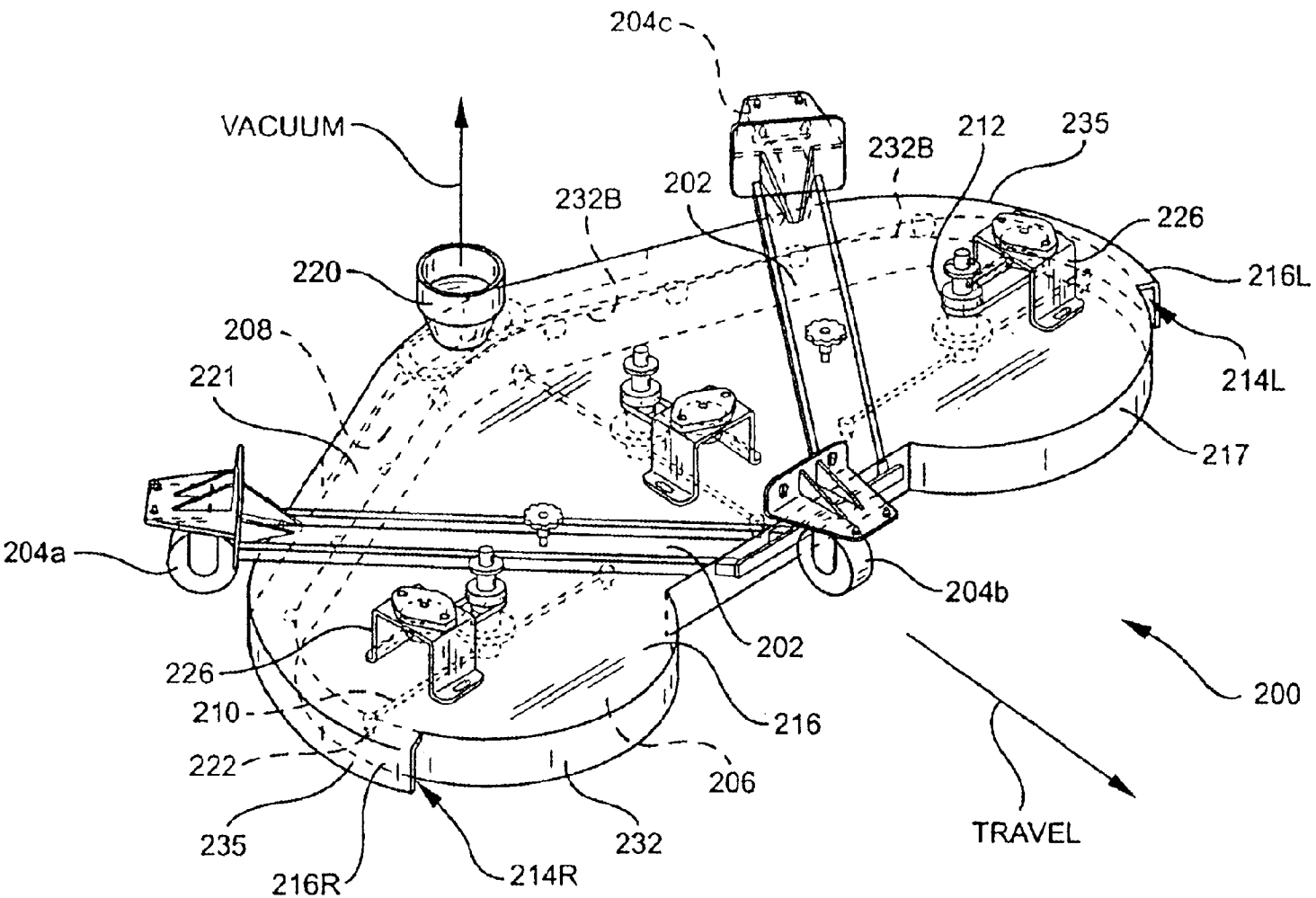
FIG. 3 is a partial perspective view of one exemplary embodiment of the brushless cleaning head system assembly in accordance with the present invention.

An exemplary embodiment of scrubless brush head 200 in accordance with the present invention is particularly described with reference to FIGS. 3–7. FIG. 3 is a perspective view of brushless scrub head 200 including a rigid deck generally indicated by numeral 216. Deck 216 includes a downwardly depending shroud member 217, at least in part, for securing a resilient skirt 232. The combination of deck 216, shroud 217 and resilient skirt 232 forms an open ended chamber 206, herein referred to as spraying chamber 206—the open end of chamber 206 being in communication with the surface intended to be cleaned.

Associated with a rearward section of deck 216 is a second open-ended chamber 208. Chamber 208 is formed in part by a resilient skirt 235 attached to shroud member 217, a chamber dividing portion resilient skirt 232 indicated by numeral 232B, and an upper chamber member 221—the open end of chamber 208 being in communication with the surface intended to be cleaned.

Resilient skirt 235 is illustrated as extending generally from left and right side portions of deck 216 generally indicated by numerals 216L and 216R, and forming left and right air inlets 214L and 214R by way of an intended separation between end extremities of skirt 235 and adjacent portion of skirt 232 in proximity to the aforesaid left and right deck sides indicated by numerals 216L and 216R of deck 216.

Chamber 208 can be characterized as providing a double skirt wall across approximately the rear one-half of chamber 206, extending from the right air inlet 214R around the rear portion of chamber 206 and to the left air inlet 216L (the double skirt wall comprising portions of skirt 232 and skirt 235). Side portions of double skirt wall (proximate to air inlets 214R and 214L) permit the capture of solution which may otherwise spray out of spraying chamber 206.

As further illustrated in the exemplary embodiment of the brushless scrub head 200 illustrated in the drawings, deck 216 is attached to frame members 202, supported by three caster wheels 204*a*–*c*. Frame members 202, by way of an example may then be coupled to lifting mechanism (not shown) and appropriate linkage associated with the transport vehicle 100 for lifting and lowering brushless scrub head deck 216 relative to the surface intended to be cleaned. In the preferred embodiment of the present invention, brushless scrub head 200 is intended to be supported by the three caster wheels to provide a consistent scrub head floating just above the surface intended to be cleaned, as illustrated in FIG. 5.

In the exemplary embodiment of the invention illustrated in the drawings, solution spraying wand system 80 includes three spinner bars 210*a*–*c* each with two nozzles 222 at opposite ends thereof. The attachment of the spinner bars 210*a*–*c* to a solution conduit 30 may be accomplished by way of water swivels 212*a*–*c*. Three independent hydraulic drive motors 224 are attached to an upper surface of deck 216 by way of mounting brackets 226, and so positioned to facilitate connection to the water swivels 212*a*–*c*, respectively, for rotating spinner bars or wands 210*a*–*c*, respectively.

Figure 4:
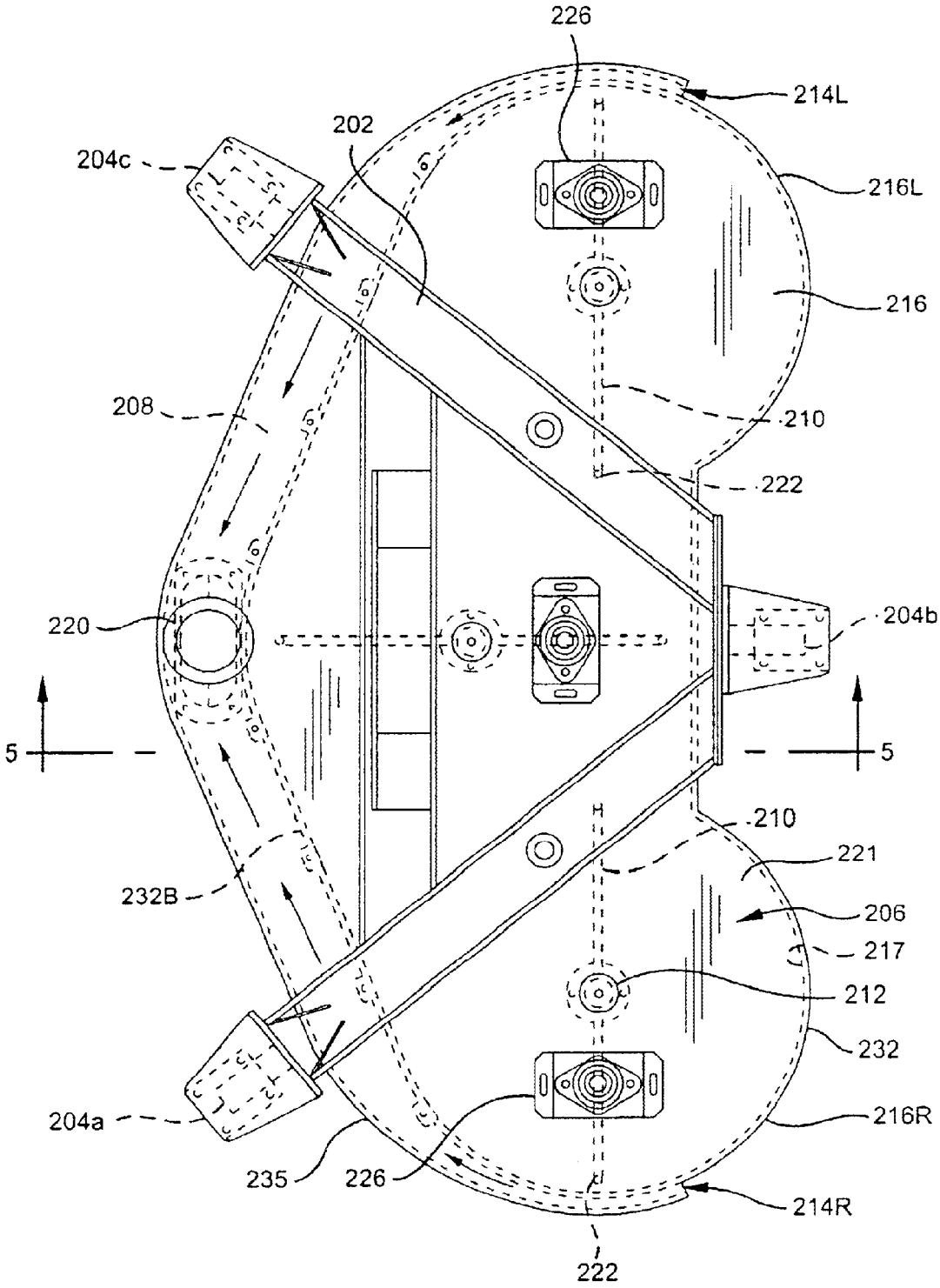
FIG. 4 is a top view of the brushless cleaning head system assembly of FIG. 3.

Illustrated in FIG. 4 is a top view of the brushless scrub head system 200 in accordance with the present invention and particularly depicting the pair of air inlets 214L and 214R in proximity to deck sides 216L and 216R respectively provided by the end portions of resilient skirt 235 and skirt 232. As illustrated in FIG. 4, primary vacuum chamber 208 is generally chevron-shaped, as defined by the inwardly directed shroud 232 faces.

Figure 5:
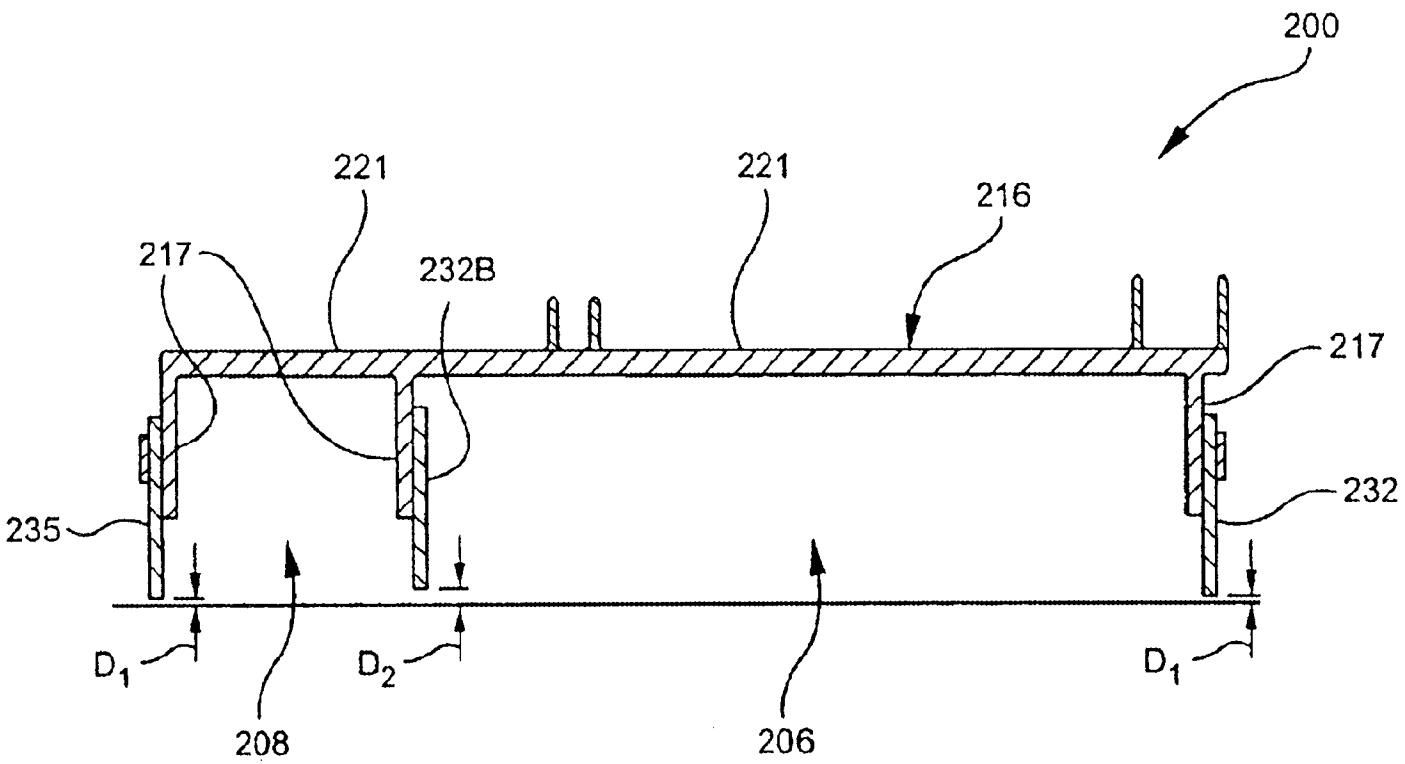
FIG. 5 is a cross sectional-view taken along lines 5—5 of FIG. 4.

FIG. 5 illustrates a cross sectional view of scrubless head system 200 taken along lines 5—5 of FIG. 4. A portion of shroud 217 and resilient member 232B acts as a divider between chamber 206 and chamber 208. Resilient members 232 and 235 are optimized to control air flow in system 200. In particular, a distance between a lower edge of resilient members 232 and 235 and the floor surface is generally indicated as distance "D1". Furthermore a distance between a lower edge of resilient member 232B and the floor surface is indicated as distance "D2". In the illustrated exemplary embodiment, distance D2 is greater than distance D1. A gap created by resilient member 232B facilitates airflow from chamber 206 into chamber 208. This airflow from chamber 206 into chamber 208 functions to minimize the amount of solution sprayed out of chamber 206 and that is not captured in chamber 208. Additionally, the airflow from chamber 206 is directed between chamber dividing portion 232B of skirt 232 and the ground surface to facilitate removal of solution from surface depressions, cracks, etc. In an exemplary embodiment, distance D1 is approximately zero (touching), and distance D2 is approximately between 1/16 to 1/8 inch.

Figure 6:
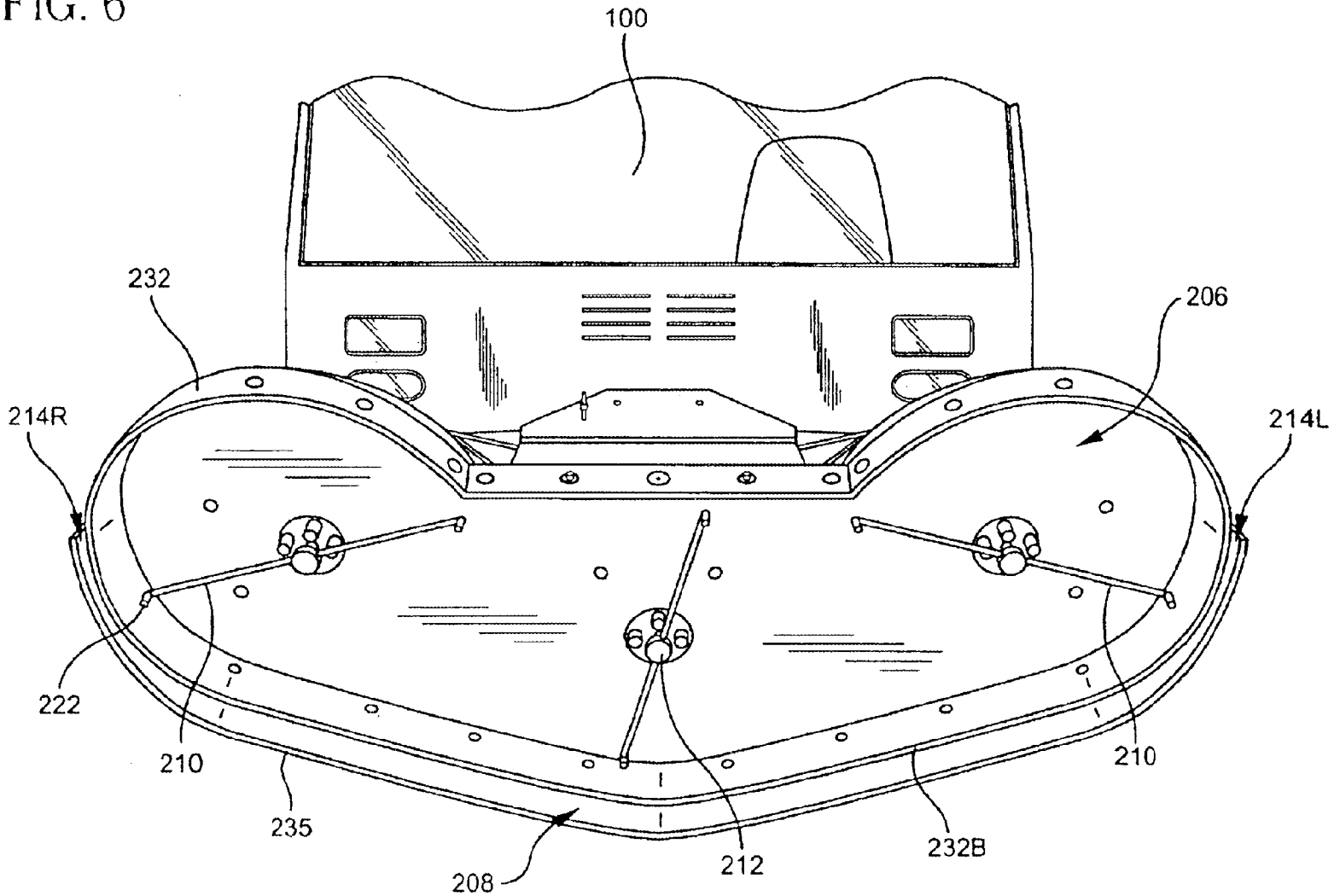
FIG. 6 is a perspective bottom view of the brushless cleaning head system assembly of FIG. 3.
Figure 7:
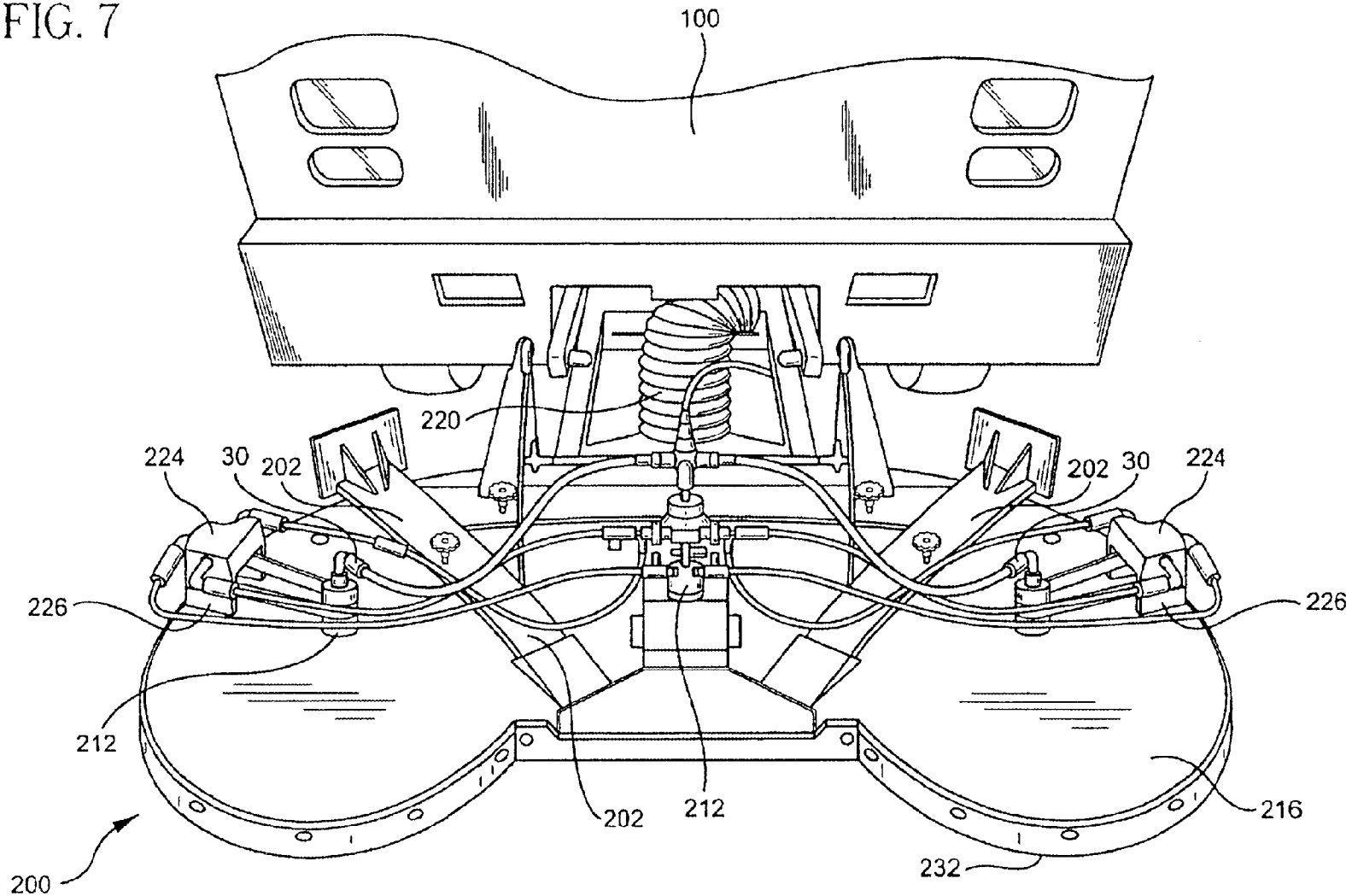
FIG. 7 is a perspective top view of the brushless cleaning head system assembly of FIG. 3.

FIGS. 6 and 7 illustrate top and bottom perspective views of the scrubless head system 200 being coupled to a surface maintenance vehicle 100, respectively.

Brushless scrub head 200 provides a forward spraying chamber 206 and a rearward vacuum chamber 208. In part, spraying chamber 206 serves as a secondary vacuum chamber provided primarily by skirt 232 and deck 216. The primary vacuum chamber 208 is coupled to vacuum system pump 114 through a conduit 40 or 220. Airflow inlets 214L and 214R accentuate removal of spent solution which enters through under surfaces of rear portions of skirt 232 which forms, in part vacuum chamber 208. Airflow from inlets 214L and 214R, indicated by arrows in FIG. 4, facilitates spent solution and debris removal by providing a relatively strong airflow to lift and/or transport solution and debris from surface cracks, undulations, pad-eyes, and other surface irregularities.

Upper chamber member 221 includes a single vacuum duct 220. In an alternative embodiment, a plurality of vacuum ports may be used to facilitate removal of spent cleaning solution and surface debris from the affected surface area. A single large vacuum duct 220 (40 in FIG. 1) may be utilized for transporting the spent cleaning solution and debris to the recovery system or recycling system 112 or any combination thereof.

In operation, flexible skirt 232*b* at the rear of the spraying chamber 206 is specifically designed in such manner to only allow sufficient airflow to be taken from the spraying chamber and enter the primary vacuum chamber 208 to prevent cleaning solution from spraying out of the front portion of the spraying chamber 206.

One embodiment of brushless scrub head system 200 of the present invention contains rotating spray wands and accompanying nozzles that are driven by a hydraulic pump and motor. The combination of the hydraulic pump and a variable pressure valve allows for controlling the spray nozzle rotation speed independent of the spray solution pressure, thereby uncoupling the rotation speed from the solution spray pressure. The present invention has solved problems with existing pressurized cleaning systems where the rotation speed of the sprayer arms is created as a reaction to spray solution exiting the fluid nozzles.

It should be noted that the sprayed cleaning solution used in concert with the inventive brushless cleaning head system, may be an aqueous cleaning solution or a combination aqueous and miscible solvent solution. The aqueous and miscible solvent combination may be combined by one of several methods. One specific embodiment is an injection pump mixing system whereby the two liquids are mechanically mixed. A second embodiment is an aspiration mechanism whereby the two liquids are combined at the spray nozzle.

The solution recovery system may be any number of combinations of a solution recovery tank, a solution recycling system, a solution tank, a solvent tank, and any number of vacuums and pumps along with the requisite pipes and valves necessary to power and connect the components of the system.

Resilient skirts 232 and 235 may be constructed by way of a wide array of resilient materials, e.g., rubber, plastics, and the like which function in part as squeegees and develop the requite chambers as described herein.

In accordance with the present invention, a control system may be employed to regulate the combined solution spray pressure exiting the nozzles and the speed of rotation of the wands in relation the speed of the transport vehicle in order to optimize cleaning performance in the intended application. Of course, the aforementioned control characteristics are dependent upon the selected nozzles and resulting spray patterns and angle of attack relative to the surface intended to be cleaned.

Although a multiple wand system has been illustrated in the drawings, a single wand system is within the true spirit and scope of the present invention. Furthermore, although a recovery system has been illustrated coupled directly to the spraying chamber, independent control of both exiting solvent pressure and speed of rotation of the wands without a jointly coupled recovery system is within true sprit and scope of the present invention.

It should be recognized that spraying chamber 206 as well as vacuum chamber 208 may be constructed by wide array of manufacturing techniques and configurations in order to achieve the intended functions.

Although the invention has been described in connection with particular embodiments thereof other embodiments, applications, and modifications thereof which will be obvious to those skilled in the relevant arts are included within the spirit and scope of the invention.

We claim:

1. A device for use in a ground surface cleaning operation, said device comprising:

a transportable deck having at least a first chamber and a second chamber, each first and second chamber being in open communication with the surface, said first chamber having a nozzle for directing a pressurized cleaning solution toward the ground surface, said nozzle being attached to a rotatable member, and said second chamber having a vacuum outlet for removing cleaning solution and debris from the surface, wherein each first and second chamber is defined at least in part by downwardly depending flexible skirting, wherein said first and second chambers are separated at least in part by a chamber dividing portion of said flexible skirting, wherein said first chamber has a forward portion in a direction of travel, wherein said second chamber is formed at a rearward portion of the first chamber, and wherein said second chamber draws an airflow from the first chamber to minimize spray out of the deck from the forward portion, said airflow being directed under the chamber dividing portion of the flexible skirting to facilitate removal of solution from contours of the ground surface.

2. The device of claim 1, wherein the deck includes a peripheral downwardly-extending shroud to which at least a portion of the flexible skirting is connected.

3. The device of claim 1, wherein the nozzle is attached proximate to a distal end of the rotatable member.

4. The device of claim 3, wherein the rotatable member is selectively driven by a drive mechanism.

5. The device of claim 4, wherein the drive mechanism comprises a hydraulic motor.

6. The device of claim 3, wherein the deck includes a plurality of rotatable spinner bars, said plurality of rotatable spinner bare being aligned in a generally transverse direction relative to a direction of motion.

7. The device of claim 6, wherein the second chamber is generally elongated in said transverse direction.

8. The device of claim 7, wherein the second chamber is generally chevron-shaped and includes a plurality of inwardly directed skirt faces.

9. The device of claim 1, wherein a portion of the skirting is provided in touching contact with the ground surface.

10. The device of claim 1, wherein a portion of the skirting is in wiping contact with an uneven surface.

11. The device of claim 1, wherein the second chamber includes a pair of air inlets, said pair of air inlets permitting an airflow through the second chamber to facilitate removal of spent cleaning solution and debris upon the ground surface.

12. The device of claim 11, wherein the pair of air inlets are defined by gaps between a first skirt portion and a second skirt portion.

13. The device of claim 1, wherein the first and second chambers are each maintained at an associated pressure, each associated pressure being lower than ambient pressure.

14. The device of claim 13, wherein the second chamber is maintained at an associated pressure which is substantially different than the associated pressure of the first chamber.

15. The device of claim 1, wherein different portions of the flexible skirting have a different gap distance between a lower edge of the skirting and the ground surface to optimize an airflow within the device.

16. The device of claim 15, wherein the chamber dividing portion of the flexible skirting has a larger gap distance as compared to other portions of the flexible skirting.

17. The device of claim 1, further comprising a plurality of wheels for movably supporting the device upon the ground surface during operation.

18. A vehicle for cleaning a ground surface, said vehicle being transportable across the ground surface during a cleaning operation, said vehicle comprising:

a vacuum source;

a pressurized cleaning solution source; and a transportable deck having at least a first chamber and a second chamber, each first and second chamber being in open communication with the surface, said first chamber having a nozzle for directing a pressurized cleaning solution toward the ground surface, said nozzle being attached to a rotatable member, and said second chamber having a vacuum outlet for removing cleaning solution and debris from the surface, wherein each first and second chamber is defined at least in part by downwardly depending flexible skirting, said first and second chambers being separated at least in part by a chamber dividing portion of said flexible skirting, said first chamber having a forward portion, said second chamber formed around a rearward portion of the first chamber, and wherein said second chamber draws an airflow from the first chamber to minimize spray cut of the deck from the forward portion, said airflow being directed under the chamber dividing portion of the flexible skirting to facilitate removal of solution from contours of the ground surface.

19. The vehicle of claim 18, wherein the cleaning deck includes a peripheral downwardly-extending shroud to which at least a portion of the flexible skirting is connected.

20. The vehicle of claim 18, wherein the nozzle is attached proximate to a distal end of the rotatable member.

21. The vehicle of claim 20, wherein the rotatable member is selectively driven by a drive mechanism.

22. The vehicle of claim 21, wherein the drive mechanism comprises a hydraulic motor.

23. The vehicle of claim 20, wherein the cleaning deck includes a plurality of rotatable spinner bars, said plurality of rotatable spinner bars being aligned in a generally transverse direction relative to a direction of motion.

24. The vehicle of claim 23, wherein the second chamber is generally elongated in said transverse direction.

25. The vehicle of claim 24, wherein the second chamber is generally chevron-shaped and includes a plurality of inwardly directed skirt faces.

26. The vehicle of claim 18, wherein a portion of the skirting is in contact with the surface.

27. The vehicle of claim 18, wherein the second chamber includes a pair of air inlets.

28. The vehicle of claim 27, wherein the pair of air inlets are provided on generally opposite sides of the deck.

29. The vehicle of claim 27, wherein the pair of air inlets are defined by gaps between a first skirt portion and a second skirt portion.

30. The vehicle of claim 18, further comprising a solution recovery system for receiving solution from the surface, removing debris from the received solution, and returning cleaned solution for subsequent reapplication to the surface.

31. The vehicle of claim 30, wherein the solution recovery system includes a filter for cleaning the spent solution.

32. A method of cleaning a surface with pressurized cleaning solution and recovering spent cleaning solution with a vacuum device, said method comprising the steps of:

providing a transportable deck having at least a first chamber and a second chamber, each first and second chamber being in open communication with the surface, said first chamber having a nozzle for directing a pressurized cleaning solution toward the ground surface said nozzle being attached to a rotatable member, and said second chamber having a vacuum outlet for removing spent cleaning solution and debris from the surface, wherein each first and second chamber is defined at least in part by downwardly depending flexible skirting, said first and second chambers being separated at least in part by a chamber dividing portion of said flexible skirting, said first chamber having a forward portion, said second chamber formed around a rearward portion of the first chamber, and wherein said second chamber draws an airflow from the first chamber to minimize spray out of the deck from the forward portion, said airflow being directed under the chamber dividing portion of the flexible skirting to facilitate removal of solution from contours of the ground surface;

selectively coupling the nozzle to a source of pressurized cleaning solution, so that cleaning solution is directed out of said nozzle toward the surface; and selectively coupling the vacuum outlet to the vacuum device, so that spent solution upon the surface is removed through the vacuum outlet.

33. The method of claim 32, wherein the nozzle is provided proximate to a distal end of the rotatable member.

34. The method of claim 33, wherein the rotatable member is a spinner bar selectively rotated by a drive mechanism.

35. The method of claim 34, wherein the drive mechanism comprises a hydraulic motor.

36. The method of claim 32, wherein the movable deck includes a plurality of rotatable spinner bars, said plurality of rotatable spinner bars being aligned in a generally transverse direction relative to a direction of motion.

37. The method of claim 32, wherein the second chamber is generally elongated in said transverse direction.

38. The method of claim 32, wherein a portion of the skirting is in wiping contact with an uneven ground surface.

39. The method of claim 32 further comprising the steps of:

recycling recovered spent cleaning solution from the surface for subsequent reapplication to the surface.

40. A device for use in a ground surface cleaning operation, said device comprising:

a transportable deck having at least a first chamber and a second chamber, each first and second chamber being in open communication with the surface, said first chamber having a nozzle for directing a pressurized cleaning solution toward the ground surface, and said second chamber having a vacuum outlet for removing cleaning solution and debris from the surface, wherein each first and second chamber is defined at least in part by downwardly depending flexible skirting, wherein said first and second chambers are separated at least in part by a chamber dividing portion of said flexible skirting, and wherein said second chamber draws an airflow from the first chamber to minimize spray out of the deck, said airflow being directed under the chamber dividing portion of the flexible skirting to facilitate removal of solution from contours of the ground surface, wherein the second chamber includes a pair of air inlets, said pair of air inlets permitting an airflow through the second chamber to facilitate removal of spent cleaning solution and debris upon the ground surface, and wherein the pair of air inlets are defined by gaps between a first skirt portion and a second skirt portion.

41. A device for use in a ground surface cleaning operation, said device comprising:

a transportable deck having at least a first chamber and a second chamber, each first and second chamber being in open communication with the surface, said first chamber having a nozzle for directing a pressurized cleaning solution toward the ground surface, and said second chamber having a vacuum outlet for removing cleaning solution and debris from the surface, wherein each first and second chamber is defined at least in part by downwardly depending flexible skirting, wherein said first and second chambers are separated at least in part by a chamber dividing portion of said flexible skirting, and wherein said second chamber draws an airflow from the first chamber to minimize spray out of the deck, said airflow being directed under the chamber dividing portion of the flexible skirting to facilitate removal of solution from contours of the ground surface, and wherein chamber dividing portion of the flexible skirting has a larger gap distance between a lower edge of the skirting and the ground surface as compared to other portions of the flexible skirting.

* * * * *

UNITED STATES PATENT AND TRADEMARK OFFICE

CERTIFICATE OF CORRECTION

PATENT NO. : 6,896,742 B2
DATED : May 24, 2005
INVENTOR(S) : Geyer, Robert A. et al.

It is certified that error appears in the above-identified patent and that said Letters Patent is hereby corrected as shown below:

Column 6,
Line 25, delete “bare” and insert -- bars --.

Column 7,
Line 15, delete “cut” and insert -- out -- .

Signed and Sealed this

Thirtieth Day of August, 2005

JON W. DUDAS
*Director of the United States Patent and Trademark Office*